United States Patent [19]

Ohara et al.

[11] 4,375,210

[45] Mar. 1, 1983

[54] AIR-FUEL RATIO CONTROL SYSTEM

[75] Inventors: Yoshiaki Ohara; Masaaki Ohgami, both of Musashino, Japan

[73] Assignees: Fuji Jukogyo Kabushiki Kaisha, Tokyo; Nissan Motor Co., Ltd., Yokohama, both of Japan

[21] Appl. No.: 221,462

[22] Filed: Dec. 30, 1980

[30] Foreign Application Priority Data

Jan. 31, 1980 [JP] Japan ..... 55-10678

[51] Int. Cl.[3] ..... F02M 7/02

[52] U.S. Cl. ..... 123/440; 123/492

[58] Field of Search ..... 123/440, 492, 489

[56] References Cited

U.S. PATENT DOCUMENTS

| | | | |
|---|---|---|---|
| 4,119,072 | 10/1978 | Asano | 123/440 |
| 4,131,091 | 12/1978 | Asano et al. | 123/440 |
| 4,143,623 | 3/1979 | Norimatsu et al. | 123/440 |
| 4,167,924 | 9/1979 | Carlson et al. | 123/440 |

*Primary Examiner*—Charles J. Myhre
*Assistant Examiner*—Andrew M. Dolinar
*Attorney, Agent, or Firm*—Martin A. Farber

[57] ABSTRACT

A system for controlling air-fuel ratio for a carburetor for an internal combustion engine having an induction passage, a throttle valve, an exhaust passage, a detector such as an oxygen sensor for detecting the concentration of oxygen in the exhaust gases, air-fuel mixture supply unit, an on-off electromagnetic valve for correcting the air-fuel ratio of the air-fuel mixture supplied by the air-fuel mixture supply unit and electronic controller. The electronic controller comprises a comparator for comparing the output signal of the detector with a set value, an integrating circuit connected to the comparator, a triangular wave pulse generator, and a driving circuit for producing square wave pulses for driving the on-off electromagnetic valve(s) for output signals of the integrating circuit and of the triangular wave pulse generator for controlling the air-fuel ratio to a value approximately equal to the stoichiometric air-fuel ratio. A constant signal generating circuit is selectively connected operatively to the electronic controller. An engine operation detector for detecting a wide open condition of the throttle valve produces a signal during the wide open condition. A switching circuit operatively connects the constant signal generating circuit to the electronic controller for providing a fixed duty ratio of the valve, and renders the electronic controller nonresponsive to the output of the exhaust gas detector. The switching circuit is adapted to be operated by the signal of the engine operation detector. A delay circuit is provided to delay the operation of the switching circuit. Thus, the on-off electromagnetic valve is operated at a fixed duty ratio after the wide open condition continues a predetermined period.

5 Claims, 8 Drawing Figures

AIR-FUEL RATIO CONTROL SYSTEM

BACKGROUND OF THE INVENTION

The present invention relates to a system for controlling the air-fuel ratio for an internal combustion engine emission control system with a catalytic converter comprising a three-way catalyst, and more particularly to a system which may temporarily keep the air-fuel ratio at the stoichiometric air-fuel ratio during a high power operating condition of the engine.

Such a control system is a feedback control system, in which the system comprises an oxygen sensor for detecting the concentration of oxygen in the exhaust gases, an air-fuel mixture supply unit, an on-off type electromagnetic valve for correcting the air-fuel ratio of the air-fuel mixture supplied by the air-fuel mixture supply unit, and an electronic control circuit. The electronic control circuit comprises a comparator for comparing the output signal of the oxygen sensor with a predetermined value, an integrating circuit which is connected to the comparator for integrating the output of the comparator, and a driving circuit connected to the integrating circuit for producing driving pulses for driving the on-off type electromagnetic valve. The oxygen sensor generates an electrical signal as an indication of the air-fuel ratio of the air-fuel mixture induced in the engine cylinder.

The output voltage of the oxygen sensor is higher than a predetermined voltage when the oxygen concentration of the exhaust gases is smaller than a predetermined ratio corresponding to the stoichiometric air-fuel ratio in the air-fuel mixture for the combustion of the mixture and is lower than the predetermined voltage when the oxygen concentration is greater than the predetermined ratio. The duty ratio of the driving pulse train varies in dependency on the output of the integrating circuit to correct the air-fuel ratio of the mixture to be supplied to the cylinder to the stoichiometric air-fuel ratio.

In such a system, when the engine is rapidly accelerated, which is called WOT (Wide Open Throttle) condition, the duty ratio is fixed to a predetermined value by the operation of system, in order to provide a rapid acceleration. On the other hand, the air-fuel ratio greatly deviates from the stoichiometric value for 2 or 3 seconds after the wide opening of throttle valve. When the engine operation changes from the transient state to the steady state, the air-fuel ratio reaches the stoichiometry. Therefore, if the duty ratio is fixed to a predetermined value in WOT condition where the controlled air-fuel ratio greatly deviates from the stoichiometry, the purification effect of the emission control system is extremely reduced although the acceleration effect of the engine may be effected.

SUMMARY OF THE INVENTION

The object of the present invention is to provide an electronic control system which operates to fix the duty ratio of the valve driving pulses to a predetermined value after the WOT condition continues a predetermined time, whereby purification operation of the emission control system may be effected in a short period WOT condition.

According to the present invention, there is provided an air-fuel control system for a carburetor of an internal combustion engine having an intake passage, a throttle valve in the intake passage, an exhaust passage, first detector means for detecting the concentration of a constituent of the exhaust gases passing through the exhaust passage, and on-off electromagnetic valve means for correcting the air-fuel ratio of the air-fuel mixture supplied by an air-fuel mixture supply means, with the improvement comprising electronic control means comprising a comparator for comparing an output signal of said first detector means with a predetermined value, an integrating circuit means, and a driving circuit for producing a driving output for driving said electromagnetic valve means in dependency on an output signal of said integrating circuit means for controlling the air-fuel ratio to a value approximately equal to the stoichiometric air-fuel ratio, second detector means for detecting the condition of operation of said internal combustion engine and for producing a detected signal during the wide open condition of said throttle valve, fixed signal generating circuit means for said driving circuit, switch means adapted to be operated by said detected signal of said second detector means for rendering the output signal of said integrating circuit ineffective and for feeding said fixed signal to said driving circuit, delay circuit means provided to delay the operation of said switch means, whereby said electromagnetic valve means is operated at a predetermined duty ratio after said wide open condition of the throttle valve continues a predetermined period.

Other objects and features of the present invention will become apparent from the following description of a preferred embodiment with reference to the accompanying drawings.

BRIEF DESCRIPTION OF THE DRAWING

FIGS. 4A to 4D show variations of air-fuel ratios.

DETAILED DESCRIPTION OF THE PREFERRED EMBODIMENTS

Figure 1:
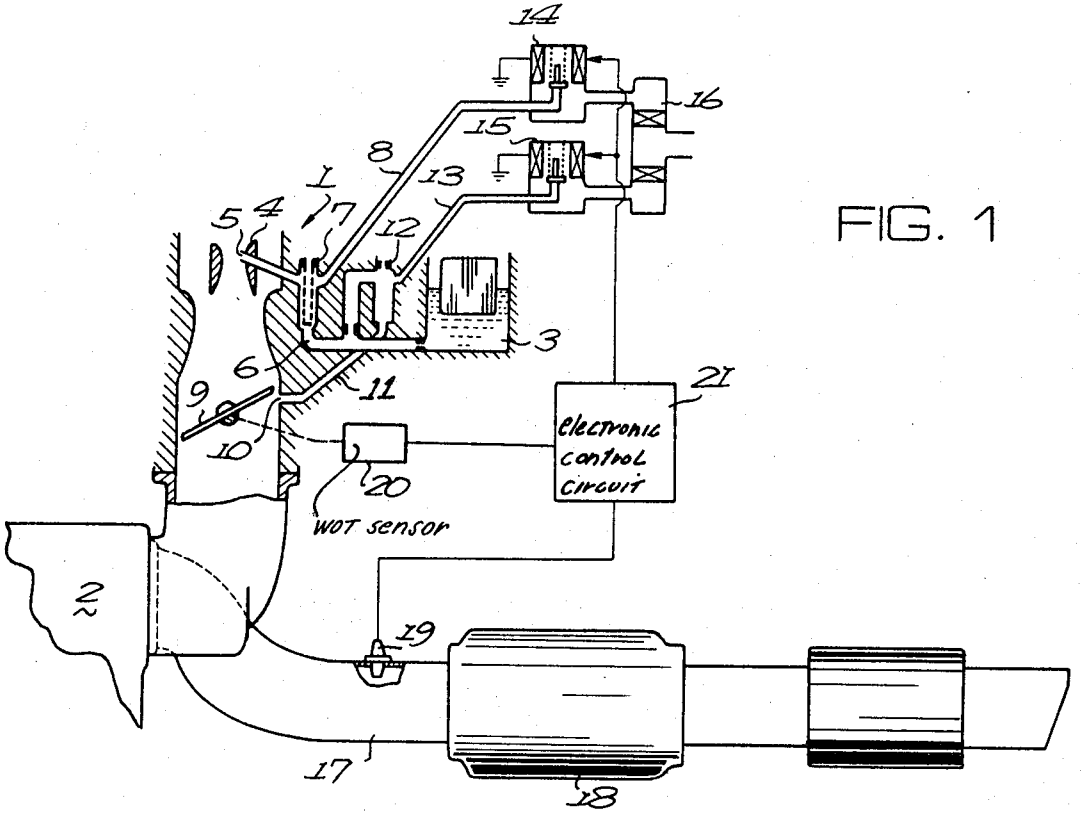
FIG. 1 is a schematic view of a system for controlling air-fuel ratio according to the present invention.

Referring to FIG. 1, a carburetor 1 communicates with an internal combustion engine 2. The carburetor comprises a float chamber 3, a venturi 4, a nozzle 5 communicating with the float chamber 3 through a main fuel passage 6, and a slow port 10 communicating with the float chamber 3 through a slow fuel passage 11. Air correcting passages 8 and 13 are provided in parallel to a main air bleed 7 and a slow air bleed 12, respectively. On-off type electromagnetic valves 14 and 15 are provided for the air correcting passages 8 and 13. An inlet port of each on-off electromagnetic valve communicates with the atmosphere through an air cleaner 16. An oxygen sensor 19 is provided on an exhaust pipe 17 upstream of a three-way catalyst converter 18 for detecting the oxygen concentration of the exhaust gases.

A WOT sensor 20 comprising a potentiometer-type transducer is operatively connected to a throttle valve 9 in order to detect an acceleration opening of the throttle valve 9. Output signals of sensors 19 and 20 are sent to an electronic control circuit 21 for actuating the on-off type electromagnetic valves 14 and 15 to control the air-fuel ratio of the mixture to a value approximately equal to the stoichiometric air-fuel ratio.

Figure 2:
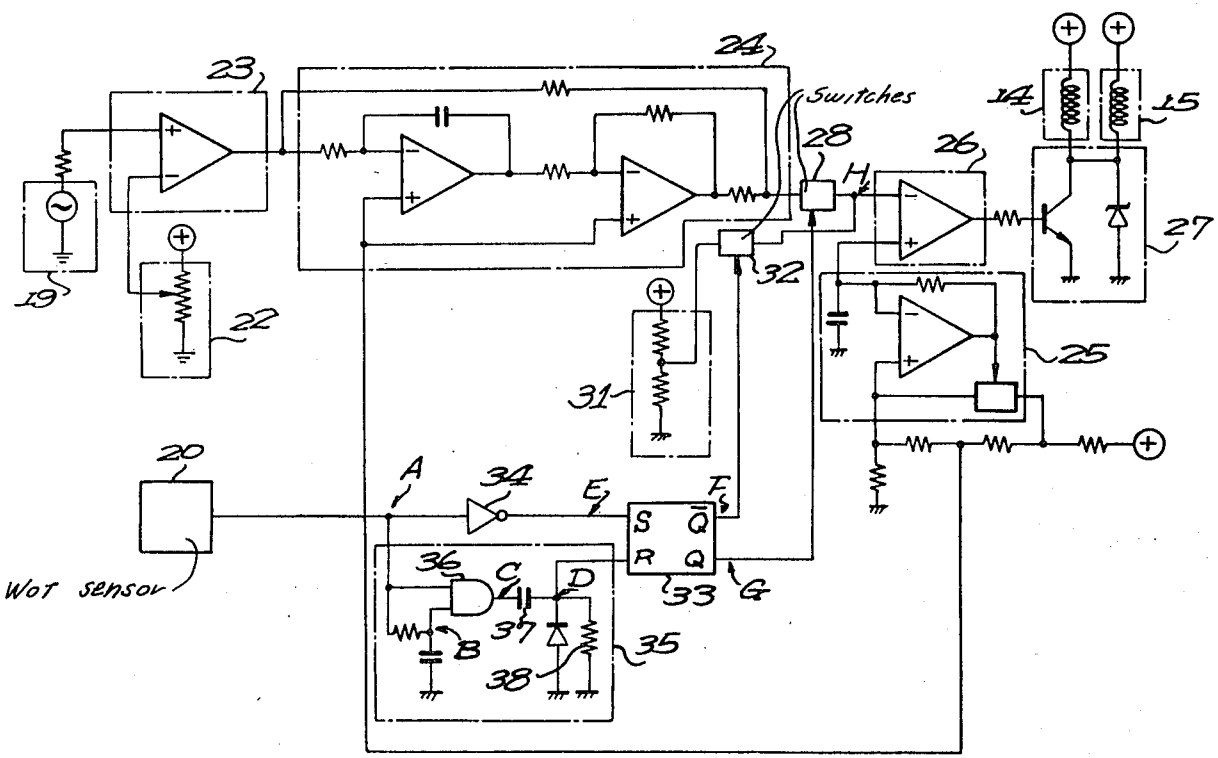
FIG. 2 is an electronic control circuit according to the present invention.

Referring to FIG. 2, the output signal of the oxygen sensor 19 is fed to a comparator 23. The comparator 23 operates to compare the input signal with a set value applied from a set value circuit 22 to produce a deviation signal. The deviation signal is fed to a proportional and integrating circuit 24, so that the deviation signal is converted into a proportional and integrating signal. The proportional and integrating signal is fed to a comparator 26 and is compared with triangular pulses fed from a triangular wave pulse generator 25, so that square wave pulses are produced. The square wave pulses are fed to a driving circuit 27 and further both of the on-off type electromagnetic valves 14 and 15 are actuated.

In accordance with the present invention, the proportional and integrating circuit 24 is connected to the comparator 26 through a semiconductor switch 28 such as a MOSFET switch and a fixed duty ratio signal generating circuit 31 is connected to the comparator 26 through a semiconductor switch 32. The control gate of the switch 28 is connected to the Q output of an R.S flip-flop 33 and the control gate of the switch 32 is connected to $\overline{Q}$ output of the flip-flop 33. The S input of the flip-flop 33 is connected to the WOT sensor 20 through an inverter 34 and the R input is connected to the sensor 20 through a delay circuit 35 comprising an AND gate 36, capacitor 37 and resistor 38.

Figure 2A:
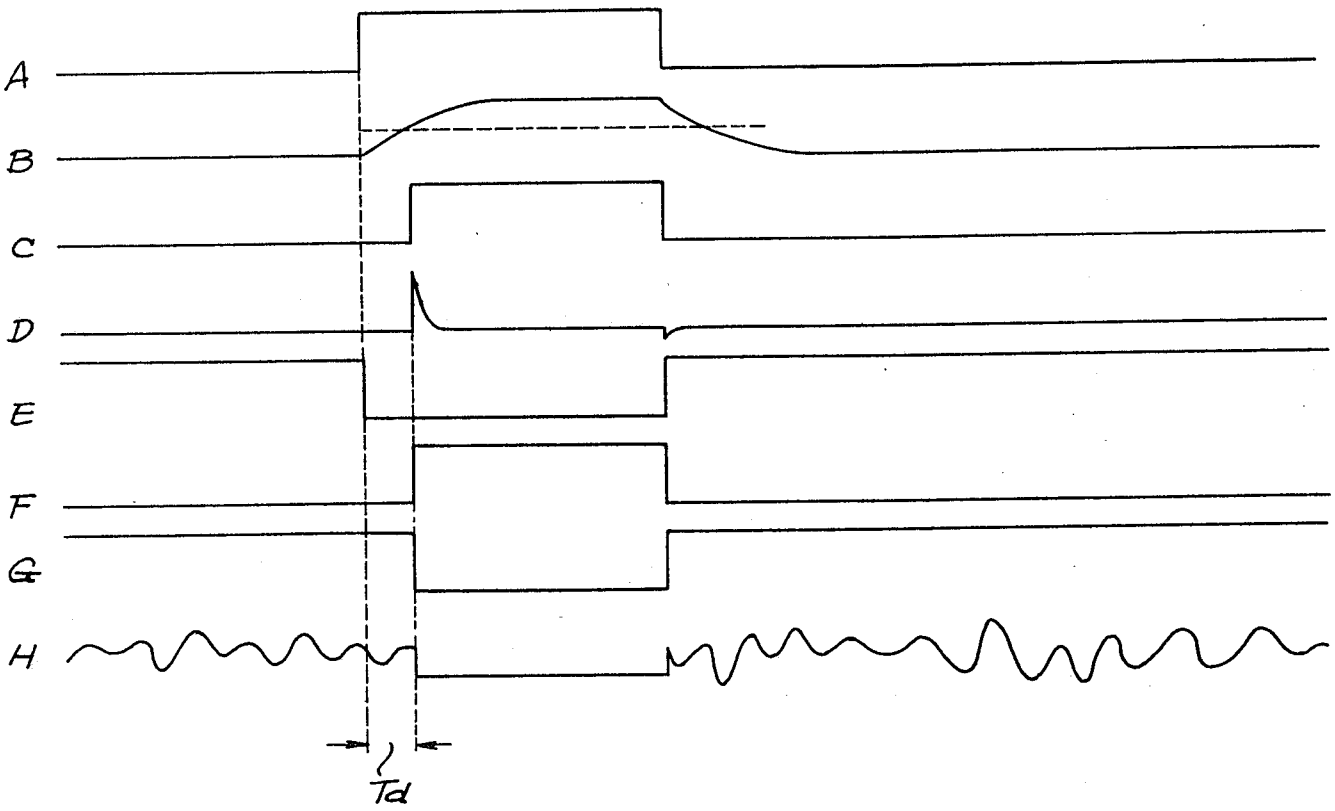
FIG. 2*a* shows waveforms at various portions in the circuit of FIG. 2.

In the steady state of the engine operation, the level of the output A of the WOT sensor 20 is low as shown in FIG. 2*a*. Therefore, the output G of the flip-flop 33 is high and the output F is low, so that the switch 28 is closed and the switch 32 is opened. Thus, the proportional and integrating circuit 24 is connected to the comparator 26. In such a condition, when exhaust gases having a small oxygen concentration are detected by the oxygen sensor 19, the proportional and integrating circuit 24 produces an output signal for correcting the deviation of the air-fuel ratio. According to the output signal, the driving circuit 27 produces output pulses having a greater pulse duty ratio, whereby the opening times of the on-off type electromagnetic valves 14 and 15 increase and as a result the amount of air passing through in the mixture fed from the carburetor 1 increases to thereby increase the air-fuel ratio. When a lean air-fuel ratio is detected, the driving pulses having a small pulse duty ratio are produced, whereby the air-fuel ratio is decreased to enrich the mixture fed from the carburetor.

When the throttle valve 9 is widely opened, the output A of the WOT sensor 20 will go to a high level. The reset signal D is fed to the flip-flop 33 with a delay Td as shown in FIG. 2*a*. Thus, after delay time Td, the switch 32 is closed and switch 28 is opened. Therefore, a fixed duty ratio signal is fed from the circuit 31 to the comparator 26 through the switch 32. Reference H of FIG. 2*a* shows the fixed duty ratio signal. Thus, valves 14 and 15 are driven with the fixed duty ratio to provide a rich air-fuel ratio for increasing the acceleration effect. When the WOT condition terminates, the above described feedback control takes place again.

Figure 3:
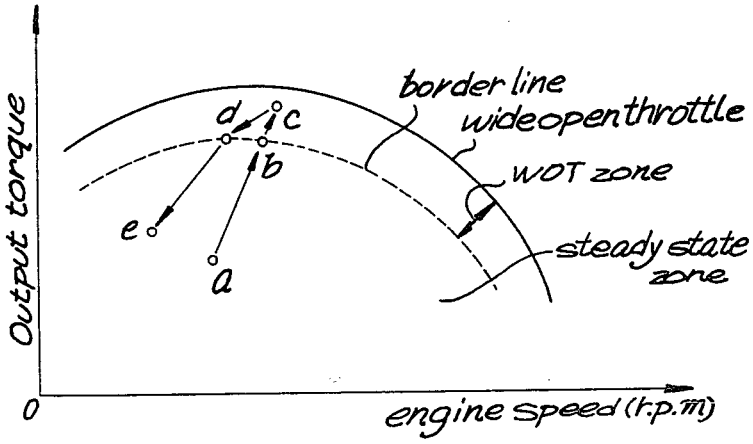
FIG. 3 shows a graph of an output characteristics of an engine.
Figure 3:
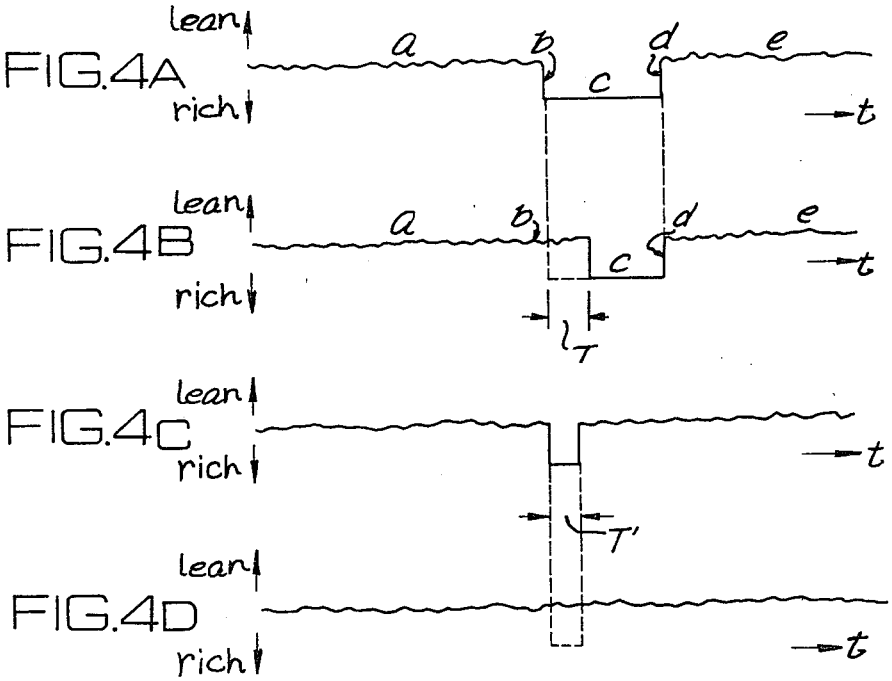

FIG. 3 shows engine speed in rpm v. output torque. If the engine output changes as a→b→c→d→e, outputs a and e are in the steady state region, b and d are on the border line and c is in the WOT region. FIGS. 4A and 4C show variation of the air-fuel ratio by a conventional system during the operation shown in FIG. 3 and FIGS. 4B and 4D show the variation by the system of the present invention. Reference characters a to e in FIG. 4 correspond to those of FIG. 3.

In accordance with the system of the present invention, the rich air-fuel ratio c in the WOT region occurs after the time delay T as shown in FIG. 4B. If the period of time T′ of the rich air-fuel ratio in the WOT region is shorter than the time delay T as shown in FIG. 4C, rich air-fuel ratio control is not effected in the system of the present invention as shown in FIG. 4D.

In the illustrated embodiment, although a throttle valve sensor is provided for detecting the WOT condition, other devices such as vacuum sensor detecting the vacuum pressure in the induction passage of the engine or a switch operated by the acceleration pedal may be employed.

In accordance with the present invention, the duty ratio of the pulse for the drive of the electromagnetic valves is fixed after the WOT condition continues a predetermined time. Thus, the reduction of the purification effect in the short initial period of the WOT condition may be prevented.

What is claimed is:

1. In an air-fuel ratio control device for an air-fuel mixture supply means of an internal combustion engine having an intake passage, a throttle valve in the intake passage, an exhaust passage, first detector means for detecting the concentration of a constituent of exhaust gases passing through said exhaust passage, and on-off electromagnetic valve means for correcting the air-fuel ratio of the air-fuel mixture supplied by an air-fuel mixture supply means, the improvement comprising electronic control means for controlling the air-fuel ratio to a value approximately to the stoichiometric air-fuel ratio, comprising comparator means for comparing an output signal of said first detector means with a set value, an integrating circuit and driving circuit means for producing a driving output for driving said electromagnetic valve means in dependency on an output signal of said integrating circuit, second detector means for detecting the condition of operation of said internal combustion engine and producing a detected signal during the wide open condition of said throttle valve, fixed signal generating circuit means for fixing the air-fuel ratio to a predetermined duty ratio for said driving circuit means switch means adapted to be operated by said detected signal of said second detector means for rendering the output signal of said integrating circuit ineffective and for feeding said fixed signal to said driving circuit means, actuating means for actuating said switch means, said actuating means being an R.S. flip-flop, delay circuit means for delaying the operation of said switch means being connected with one of the inputs of said R.S. flip-flop, whereby said electromagnetic valve means is operated at a predetermined duty ratio after said wide open condition of the throttle valve continues a predetermined period.

2. The air-fuel ratio control device as set forth in claim 1, wherein said delay circuit means includes, an AND gate having one input connected to said second detector means, a resistor, a capacitor connected between said resistor and the output of said AND gate, and wherein a junction of said capacitor and said resistor is connected to said one input of said R.S. flip-flop.

3. The air-fuel ratio control device as set forth in claim 2, wherein said delay circuit means further includes, a diode connected in parallel with said resistor, a second capacitor connected to a second input of said AND gate, said resistor, said second capacitor and said diode being grounded, and a second resistor connected across said first-mentioned input and said second input of said AND gate.

4. The air-fuel ratio control device as set forth in claim 3, further comprising an inverter connected between said second detector means and the S input of said R.S. flip-flop, and wherein said one input of said R.S. flip-flop is the R input of said R.S. flip-flop.

5. The air-fuel ratio control device as set forth in claim 4, wherein said switch means comprises, a first switch connected between said integrating circuit and said driving circuit means and having a control gate connected to a Q output of said R.S. flip-flop, a second switch connected between said fixed signal generating circuit means and said driving circuit means and having a control gate connected to a $\overline{Q}$ output of said R.S. flip-flop.

* * * * *